United States Patent [19]

Mauric et al.

[11] 4,242,138

[45] Dec. 30, 1980

[54] FLAMEPROOFED REGENERATED CELLULOSE AND METHOD

[75] Inventors: Claudine Mauric, Basel; Rainer Wolf, Allschwil, both of Switzerland

[73] Assignee: Sandoz Ltd., Basel, Switzerland

[21] Appl. No.: 27,488

[22] Filed: Apr. 5, 1979

Related U.S. Application Data

[63] Continuation of Ser. No. 708,378, Jul. 26, 1976.

[30] Foreign Application Priority Data

Jul. 31, 1975 [CH] Switzerland ..... 10003/75
Nov. 19, 1975 [CH] Switzerland ..... 14992/75

[51] Int. Cl.[3] ..... C09K 3/28; C09D 5/18
[52] U.S. Cl. ..... 106/18.18; 106/18.19; 106/165; 106/168; 106/177; 252/8.1
[58] Field of Search ..... 106/165, 168, 177, 18.18, 106/18.19; 252/8.1

[56] References Cited

U.S. PATENT DOCUMENTS

| | | | |
|---|---|---|---|
| 2,952,701 | 9/1960 | McConnell et al. | 260/928 |
| 3,006,947 | 10/1961 | Lanham | 260/951 |
| 3,556,825 | 1/1971 | Lynch | 106/168 |
| 3,706,821 | 12/1972 | Anderson et al. | 106/177 |
| 3,865,604 | 2/1975 | Riedel et al. | 106/168 |
| 3,890,409 | 6/1975 | Mayerhoefer et al. | 260/927 R |
| 3,929,940 | 12/1975 | Mayerhoefer et al. | 260/930 |
| 3,968,187 | 7/1976 | Morgan et al. | 260/928 |
| 4,062,687 | 12/1977 | Mauric et al. | 106/18.18 |

FOREIGN PATENT DOCUMENTS

| | | |
|---|---|---|
| 2262336 | 6/1973 | Fed. Rep. of Germany . |
| 1156588 | 7/1969 | United Kingdom . |
| 1158231 | 7/1969 | United Kingdom . |
| 1371212 | 10/1974 | United Kingdom . |
| 1405500 | 9/1975 | United Kingdom . |

*Primary Examiner*—Lorenzo B. Hayes
*Attorney, Agent, or Firm*—Gerald D. Sharkin; Richard E. Vila; Joseph J. Borovian

[57] ABSTRACT

Flameproofed cellulose, especially regenerated cellulose, includes as a flameproofing agent an 0,0,0-triester of phosphoric acid or of thiophosphoric acid.

8 Claims, No Drawings

FLAMEPROOFED REGENERATED CELLULOSE AND METHOD

This is a continuation of application Ser. No. 708,378 filed July 26, 1976 pending in group.

The present invention relates to flameproofed cellulose.

In particular, the present invention provides flameproofed cellulose, preferably regenerated cellulose, including as a flameproofing agent a compound selected from 0,0,0-triesters of phosphoric acid and of thiophosphoric acid.

In the above and following, the term "including" or the like means the flameproofing agent is either coated on the surface of the cellulose or is incorporated therein.

Preferred flameproofed cellulose includes as a flameproofing agent a compound selected from 0,0,0-triesters of phosphoric acid and of thiophosphoric acid, wherein the phosphorus atom or atoms present in the molecule form part of a 1,3,2-dioxaphosphorinane ring.

Also preferred is flameproofed cellulose including as a flameproofing agent a compound selected from 0,0,0-triesters of phosphoric acid and of thiophosphoric acid, wherein the molecule of such a compound contains at least 2 phosphorus atoms in the form of a 0,0,0-triester of phosphoric acid and/or of thiophosphoric acid, and at least one of the phosphorus atoms is bound to three substituents which are not bound to one another, and the phosphoryl or thiophosphoryl radicals present in the molecule are bound to one another by a hydrocarbon bridge containing at least 2 carbon atoms.

The preferred flameproofed cellulose according to the present invention includes as a flameproofing agent a compound of formula I,

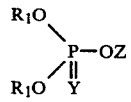

I in which

Y is oxygen or sulphur,

Z is a radical —$R_2$(a) or

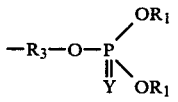

(b)

when Z is a radical (a), the $R_1$'s together form a radical (c),

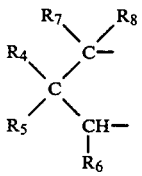

(c)

when Z is a radical (b), one, both or neither pair(s) of terminal $R_1$'s form(s) a radical (c), and in any pair not forming a radical (c), each $R_1$, independently, is methyl; ethyl or propenyl, each unsubstituted or substituted with up to 3 halogen atoms or with a ($C_{1-6}$)alkoxy radical; ($C_{3-12}$)alkyl or ($C_{4-12}$)alkenyl, each unsubstituted or substituted with up to 4 halogen atoms; ($C_{5-8}$)cycloalkyl or ($C_{5-8}$)cycloalkyl-($C_{1-4}$) alkyl, containing 7–9 carbon atoms in toto, each unsubstituted or ring substituted with 1 or 2 halogen atoms; or phenyl or phenyl-($C_{1-4}$)alkyl, each unsubstituted or ring substituted with up to 5 halogen atoms or with up to 3 ($C_{1-3}$)alkyl radicals or with up to 3 ($C_{1-3}$)alkoxy radicals, with the proviso that a maximum of two moieties $R_1$ can be methyl, $R_2$ is ($C_{2-18}$)alkyl, unsubstituted or substituted with up to 3 halogen atoms or with a ($C_{1-6}$) alkoxy radical; ($C_{3-10}$)alkenyl, unsubstituted or substituted with up to 3 halogen atoms; cyclohexyl; benzyl; or phenyl, unsubstituted or substituted with up to 5 substituents selected from chlorine and bromine atoms and methyl and ethyl radicals, with the proviso that when $R_2$ is ($C_{2-18}$)alkyl substituted with ($C_{1-6}$)alkoxy, such alkoxy substituent is not on the α-position of the alkyl radical, $R_3$ is ethylene; ($C_{3-10}$)alkylene or ($C_{4-10}$) alkenylene, each straight or branched chain and unsubstituted or substituted with 1 or 2 halogen atoms; ($C_{4-10}$)alkynylene; or a divalent radical selected from those of formulae

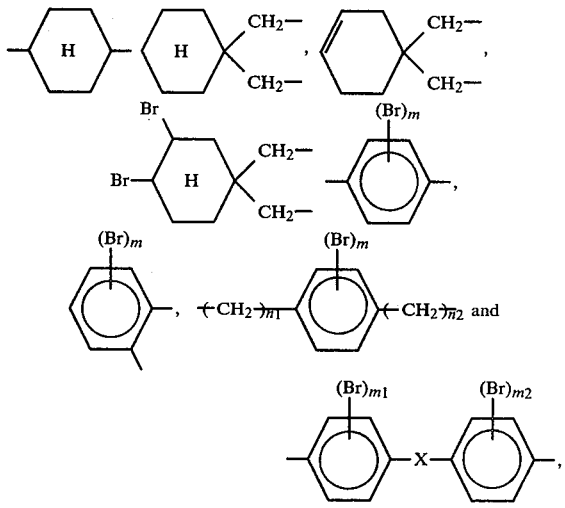

with the proviso that when $R_3$ is ($C_{3-10}$) alkylene, this cannot be alkyl-substituted methylene, either each $R_4$, independently, is hydrogen, ($C_{1-4}$)alkyl, —$CH_2Cl$, —$CH_2Br$ or phenyl, and each $R_5$, independently, is ($C_{1-4}$)alkyl, —$CH_2Cl$ or —$CH_2Br$, or any $R_4$ and $R_5$, independently from any other $R_4$ and $R_5$, together with the carbon atom to which they are bound, form a cyclohexylidene, cyclohexenylidene or 3,4-dibromocyclohexylidene ring, each $R_6$ and $R_8$, independently, is hydrogen or ($C_{1-4}$) alkyl, each $R_7$, independently, is hydrogen or methyl, with the proviso (i) that when either or both of $R_4$ and $R_5$ in any radical (c) is —$CH_2Cl$ or —$CH_2Br$, or both $R_4$ and $R_5$, together with the carbon atom to which they are bound form one of the rings indicated above, each of $R_6$, $R_7$ and $R_8$ in the same radical (c) is hydrogen, and (ii) that when Y is oxygen, each of $R_4$ and $R_5$, independently, in any radical (c) is —$CH_2Cl$ or —$CH_2Br$ or both $R_4$ and $R_5$, together with the carbon atom to which they are bound, form one of the rings indicated above, each of m, $m_1$ and $m_2$ is 0, 1, 2, 3 or 4, with the proviso that the sum of $m_1$ and $m_2$ cannot exceed 4, each of $n_1$ and $n_2$, independently, is an integer 1 to 6, and X is oxygen or sulphur.

In the above definition of formula I, it is to be understood that the term "halogen" means chlorine and bromine.

When any moiety $R_1$ is unsubstituted or substituted alkyl, the alkyl radical preferably contains 1 to 6, more preferably 3 to 6, even more preferably 3 or 4, and most preferably 3 carbon atoms. For a substituted ethyl radical the substituent is preferably a single chlorine or bromine atom, and a ($C_{3-12}$) alkyl radical, when substituted, preferably bears up to 3 chlorine or bromine atoms. In the case of $R_1$ being propyl or isopropyl, this, when substituted, more preferably bears 1 or 2 chlorine or bromine atoms. Preferably, however, any alkyl radical signified by $R_1$ is unsubstituted.

When any $R_1$ is unsubstituted or substituted cycloalkyl, this is preferably unsubstituted cyclohexyl.

When any $R_1$ is unsubstituted or substituted phenylalkyl, this is preferably optionally substituted benzyl, and more preferably unsubstituted benzyl.

When any $R_1$ is unsubstituted or substituted phenyl, this, when substituted, preferably bears up to 3 halogen atoms or up to 3 alkyl radicals. Any alkyl substituent is preferably methyl. More preferably, substituted phenyl bears up to 3 chlorine atoms or a bromine atom in the para-position. The optionally substituted phenyl radical signified by $R_1$ is preferably, however, unsubstituted.

When $R_2$ is unsubstituted or substituted alkyl, the alkyl radical preferably contains 2 to 6 carbon atoms, and more preferably 2–5 carbon atoms. The substituents are preferably 1 or 2 halogen atoms or an alkoxy radical. Any halogen or alkoxy substituent is preferably bromine or methoxy, respectively.

When $R_2$ is unsubstituted or substituted alkenyl, the alkenyl radical preferably contains 3 to 6 carbon atoms. The preferred halogen substituents are bromine, and preferably the optionally substituted alkenyl radical is 2,3-dibromoprop-2-en-1-yl.

When $R_2$ is unsubstituted or substituted phenyl, this, when substituted, preferably bears up to 3 chlorine or up to 3 bromine atoms, or up to 3 methyl radicals.

When $R_3$ is unsubstituted or substituted ($C_{3-10}$)alkylene, the alkylene radical preferably contains 3 to 6, and more preferably 3 to 5 carbon atoms, and, when substituted, preferably bears 1 or 2 chlorine or 1 or 2 bromine atoms.

When $R_3$ is unsubstituted or substituted ($C_{4-10}$)alkenylene, the alkenylene radical preferably contains 4 carbon atoms, and, when substituted, preferably bears 2 chlorine or 2 bromine atoms.

When $R_3$ is ($C_{4-10}$)alkynylene, this preferably contains 4 carbon atoms.

Of the optionally bromo substituted phenylene radicals as $R_3$, the 1,4 isomer is preferred.

When $R_3$ is a radical of formula

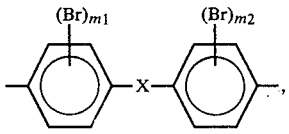

X therein is preferably sulphur.

When $R_3$ is a radical of formula

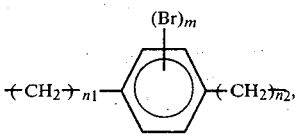

each of $n_1$ and $n_2$, independently, is preferably 1 or 2.

When $R_4$ or $R_5$ is ($C_{1-4}$)alkyl, this is preferably ($C_{1-3}$) alkyl, and more preferably methyl.

Where Y is oxygen and each of $R_4$ and $R_5$, independently, in any radical (c), is —$CH_2Cl$ or —$CH_2Br$, $R_4$ and $R_5$ are preferably identical, more preferably both —$CH_2Br$.

When $R_6$ or $R_8$ is ($C_{1-4}$)alkyl, this is preferably methyl.

Y is preferably sulphur.

Of the significances for $R_1$ given in the definition of formula I above, the preferred are unsubstituted or substituted alkyl, cycloalkyl, phenylalkyl and phenyl, and, together with the other $R_1$ bound via oxygen atoms to the same phosphorus atom, a radical (c) as defined above. More preferably $R_1$ is unsubstituted or substituted alkyl, cycloalkyl or phenyl, or, together with the other $R_1$, as indicated above, a radical (c), and most preferably the two moieties $R_1$ bound via oxygen atoms to the same phosphorus atom form a radical (c).

When 2 moieties $R_1$ form a radical (c) and Y is sulphur, $R_4$ and $R_5$ in the radical (c) preferably each signify alkyl, —$CH_2Cl$ or —$CH_2Br$ or together with the carbon atom to which they are bound form a cyclohexylidene, cyclohexenylidene or 3,4-dibromocyclohexylidene ring, and more preferably each of $R_4$ and $R_5$ signifies alkyl, —$CH_2Cl$ or —$CH_2Br$. Also in any radical (c), each of $R_6$, $R_7$ and $R_8$, independently, is preferably hydrogen.

$R_2$ is preferably unsubstituted or substituted alkenyl or phenyl.

$R_3$ is preferably unsubstituted or substituted alkylene or alkenylene, alkynylene, or one of the divalent radicals

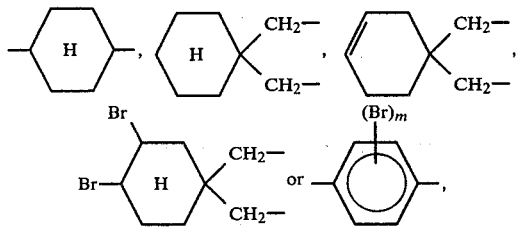

and most preferably unsubstituted or substituted alkylene or alkenylene, alkynylene or the divalent radical

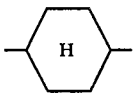

When Z is a radical (b), the compounds of formula I are preferably symmetrical, i.e. either the two pairs of terminal $R_1$'s form identical radicals (c), or the 4 $R_1$'s have identical, individual significances.

The flameproofed cellulose of the present invention more preferably includes as a flameproofing agent a compound of formula Ia,

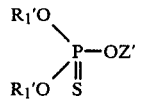

Ia in which

Z' is a radical —$R_2$' (a') or

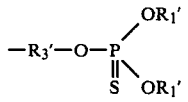

(b')

when Z' is a radical (a'), the $R_1$''s together form a radical (c')

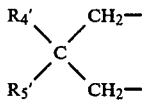

(c')

when Z' is a radical (b'), one, both or neither pair(s) of terminal $R_1$''s form(s) a radical (c'), and in any pair not forming a radical (c'), each $R_1$', independently, is ethyl; chloroethyl; bromoethyl; ($C_{3-12}$)alkyl, unsubstituted or substituted with up to 3 chlorine or up to 3 bromine atoms; cyclohexyl; benzyl; or phenyl, unsubstituted or substituted with up to 3 halogen atoms or up to 3 methyl radicals, $R_2$' is ($C_{2-6}$)alkyl, unsubstituted or substituted with up to 3 halogen atoms or a methoxy radical; 2,3-dibromoprop-2-en-1-yl; cyclohexyl; benzyl; or phenyl, unsubstituted or substituted with up to 5 substituents selected from chlorine and bromine atoms and methyl and ethyl radicals, with the proviso that when $R_2$' is ($C_{2-6}$)alkyl substituted with methoxy, such methoxy substituent is not on the α-position of the alkyl radical, $R_3$' is ethylene; ($C_{3-6}$)alkylene, straight or branched chain and unsubstituted or substituted with 1 or 2 chlorine or 1 or 2 bromine atoms; or a divalent radical selected from those of formulae

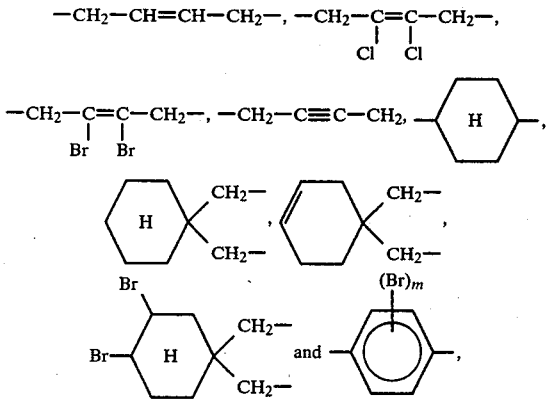

with the proviso that when $R_3$' is ($C_{3-6}$) alkylene, this cannot be alkyl-substituted methylene, each $R_4$' and $R_5$', independently, is ($C_{1-4}$)alkyl, —$CH_2Cl$ or —$CH_2Br$, or any $R_4$' and $R_5$', independently, together with the carbon atom to which they are bound, form a cyclohexylidene, cyclohexenylidene or 3,4-dibromocyclohexylidene ring, and m is 0, 1, 2, 3 or 4.

The flameproofed cellulose of the present invention most preferably includes as a flameproofing agent a compound of formula Iba, Ibb or Ibc,

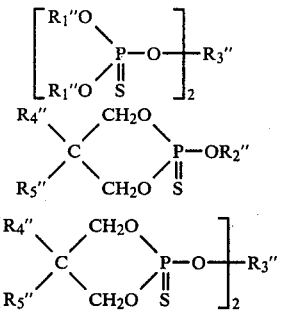

Iba

Ibb

Ibc in which each $R_1$'' is n- or iso-propyl, unsubstituted or substituted with 1 or 2 chlorine or 1 or 2 bromine atoms; or ($C_{4-6}$)alkyl, unsubstituted or substituted with up to 3 chlorine or up to 3 bromine atoms, $R_2$'' is 2,3-dibromoprop-2-en-1-yl, or phenyl, unsubstituted or substituted with up to 3 chlorine or bromine atoms or up to 3 methyl radicals, $R_3$'' is ($C_{3-5}$)alkylene, straight or branched chain and unsubstituted or substituted with 1 or 2 chlorine or 1 or 2 bromine atoms; or a divalent radical selected from those of formulae

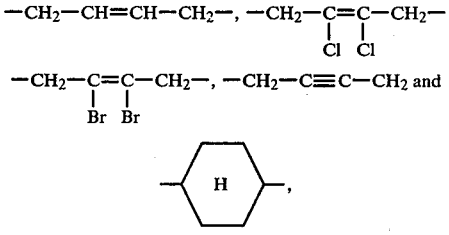

with the proviso that when $R_3$'' is ($C_{3-5}$)alkylene, this cannot be alkyl-substituted methylene, each of $R_4$'' and $R_5$'', independently, is methyl, ethyl, —$CH_2Cl$ or —$CH_2Br$, with the proviso that when $R_4$'' is —$CH_2Br$, $R_5$'' is other than —$CH_2Cl$ and when $R_5$'' is —$CH_2Br$, $R_4$'' is other than —$CH_2Cl$.

Of the compounds of formula Iba, Ibb and Ibc, those of formula Ibb and Ibc are preferred.

The flameproofed cellulose indicated hereinbefore is preferably flameproofed regenerated cellulose.

The compounds of formula I',

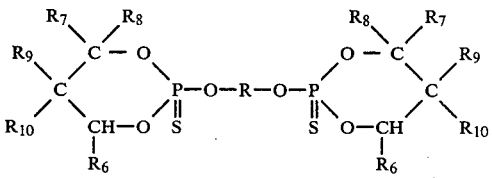

I' in which

R is ethylene; $(C_{3-10})$alkylene, straight or branched chain and unsubstituted or substituted with 1 or 2 halogen atoms; or a divalent radical selected from those of formulae

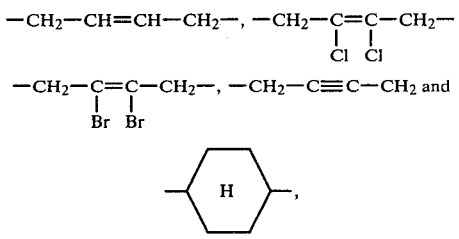

with the proviso that when R is $(C_{3-10})$ alkylene, this cannot be alkyl-substituted methylene, either each $R_9$, independently, is $(C_{1-4})$alkyl or phenyl, and each $R_{10}$, independently, is hydrogen or $(C_{1-4})$alkyl, or any $R_9$ and $R_{10}$, independently of any other $R_9$ and $R_{10}$, together with the carbon atom to which they are bound, form a cyclohexylidene, cyclohexenylidene or 3,4-dibromocyclohexylidene ring, and each of $R_6$, $R_7$ and $R_8$, independently, is as defined above, with the proviso that when each of the $R_9$'s and $R_{10}$'s is methyl, R is other than the divalent radical

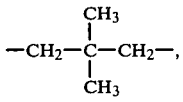

are new, and are also provided by the present invention.

The flame proofing agents used in the present invention which are not within the scope of formula I' are either known compounds and/or are producible in conventional manner from known starting materials by analogous processes to those for producing the known compounds.

In the above compounds of formula I', each $R_9$ and $R_{10}$, independently, is preferably alkyl, are preferably $(C_{1-3})$ alkyl, and most preferably methyl. R is preferably straight or branched chain $(C_{3-5})$alkylene, unsubstituted or substituted with 1 or 2 chlorine or bromine atoms, or a divalent radical selected from those of formulae

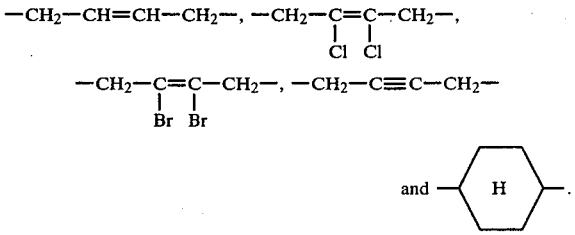

The present invention further provides a process for the production of a compound of formula I', as defined above, which comprises reacting a compound of formula II,

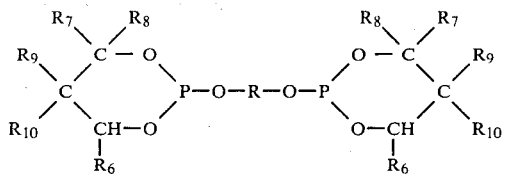

II in which R, $R_6$, $R_7$, $R_8$, $R_9$ and $R_{10}$ are as defined above, with sulphur.

As will be appreciated, each reacting molecule of the compound of formula II reacts with 2 atoms of sulphur to produce the desired product of formula I'.

This reaction may be effected under conventional reaction conditions known from analogous processes involving the same reaction principle. In general, it is suitably conducted in the presence of an inert solvent, preferably toluene, in a temperature range of 20° to 140° C., preferably 20° to 80° C.

The intermediates of formula II, as defined above, are new, and are also provided by the present invention. They may be produced by a process which comprises reacting a compound or a mixture of two compounds of formula III,

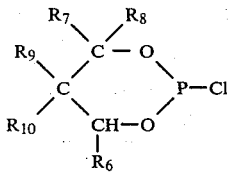

III in which $R_6$, $R_7$, $R_8$, $R_9$ and $R_{10}$ are as defined above, with a compound of formula IV,

HO—R—OH IV in which R is as defined above.

As will be appreciated, every 2 reacting molecules of the compound of formula III react with 1 molecule of the compound of formula IV to produce the desired product of formula II.

This reaction may be effected under conventional reaction conditions known from analogous processes involving the same reaction principle. In general, it is suitably conducted in the presence of an acid binding agent, preferably a tertiary amine, e.g. triethylamine or pyridine.

The intermediates of formulae III and IV, as defined above, are either known, readily available compounds or may be produced in conventional manner from known starting materials by analogous processes to those for producing the known compounds.

The present invention further provides a method of producing flameproofed cellulose comprising treating the cellulose with a flameproofing-effective amount of a compound selected from 0,0,0-triesters of phosphoric acid and of thiophosphoric acid or of any above-indicated preferred member of these classes of esters.

The flameproofing agents indicated above are useful for the flameproofing of regenerated cellulose. For this purpose cellulose is brought into solution in known manner, e.g. converted into a soluble derivative, e.g. with tetramine copper (II) hydroxide or according to the xanthate method.

To the cellulose solution produced in this way is added the flameproofing agent. The addition can be effected directly, continuously or discontinuously, with vigorous stirring of the cellulose solution. Alternatively the flameproofing agent may be first dispersed in water and added to the cellulose solution as a fine dispersion. In all cases it is advantageous to add conventional dispersion stabilisers and dispersing agents. The technically important properties of the precipitated cellulose, except the flame retardancy, are only insignificantly affected by the addition of the flameproofing agent. 5 to 35 weight percent of the flameproofing agent based on the weight of α-cellulose, can, for example, be distributed in the cellulose solution. Preferably amounts of 8–25% by weight are used. The regenerated cellulose is precipitated from the cellulose solution, which contains the flameproofing agent in known manner and in shaped form. As shaping comes above all the formation of filaments or sheets through passage of the cellulose solution into a precipitation bath with use of fine nozzles or slots. Normal precipitation baths can be used in the production of regenerated cellulose fibres or sheets. Practically the quantitative amount of the flameproofing agent contained in the cellulose solution is included in the precipitated regenerated cellulose. It is also possible to use other flameproofing substances as well as the flameproofing agents indicated above. Such compounds are, e.g. reaction products of a phosphorus nitrile chloride with glycols, e.g. neopentyl glycol or analogous compounds, or cyclodiphosphazanes or thionocyclodiphosphazanes, e.g. 2,4-dianilino-2,4-dioxo-1,3-diphenylcyclodiphosphazane.

The proportion of these further components can be varied within wide limits and can constitute up to 90% of the total amount of flameproofing composition present. Preferably 10–70%, especially 15–60% of the reaction product of phosphornitrile chloride and glycol or of a cyclodiphosphazane or thionocyclodiphosphazane, based upon the total weight of flameproofing composition, is used, whereby the latter is used in the amount indicated above.

For natural fibres the flameproofing agents used according to the invention are applied externally from a solvent or in the form of an aqueous dispersion in conventional manner. With mixtures of natural and synthetic fibres each fibrous material can be treated independently and then mixed, or the mixture itself, e.g. polyester-cotton blend, can be treated.

The present invention is illustrated by the following Examples, in which parts and percentages are by weight.

EXAMPLE 1

(a) 2-Chloro-5,5-dimethyl-1,3,2-dioxaphosphorinane is produced according to the method of H. J. Lucas et al., J.A.C.S. 72, page 5491, and is a colourless liquid of boiling point 43°–46° C./2 atmospheres.

(b) To a stirred mixture of 147.6 parts of trans-2,3-dibromo-2-butene-1,4-diol and 1040 parts of toluene under an atmosphere of nitrogen are added dropwise 202.8 parts of 2-chloro-5,5-dimethyl-1,3,2-dioxaphosphorinane at room temperature over a period of 15 minutes. The reaction mixture is cooled with ice-water and 121.2 parts of triethylamine are added dropwise at such a rate that the temperature does not exceed 30° C. During the addition, a white suspension is formed.

The reaction mixture is then stirred for 1 hour, heated to 45° C. and stirred for a further 2½ hours at this temperature.

The mixture is filtered to remove the triethylamine hydrochloride from the reaction mixture, and this is washed with toluene, followed by petroleum ether. After concentrating the filtrate to dryness, 241.7 parts of a crude product of the formula 1b

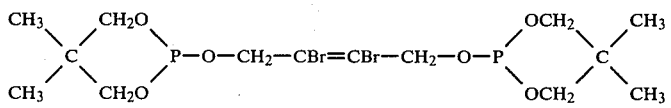

(1b), are produced, and this is purified by recrystallisation from ligroin (b.p. 80°–95° C.), affording a product of m.p. 92°–96° C.

(c) To a stirred solution of 200 parts of the purified product of formula 1b in 865 parts of toluene under an atmosphere of nitrogen are added 25.1 parts of sulphur powder in one amount at room temperature. The reaction mixture is then heated to boiling point and refluxed at this temperature for 4 hours. The clear, yellow reaction solution is then cooled to about 50° C. and the resulting white crystalline product removed by filtration. The crude product is washed with toluene and afterwards petroleum ether.

Obtained are 145 parts of the crude compound, No. 32 of table 1 following, which is purified by recrystallisation from toluene. The purified product has a melting point of 174°–177° C.

EXAMPLE 2

To 200 parts of a cellulose solution based on xanthate, which solution contains 18 parts of α-cellulose, are added with stirring 15.7 parts of a 23% aqueous dispersion of the compound No. 32 of Table 1. The dispersion is produced in the following way:

40 parts of the compound No. 32, 10 parts of a dispersing agent based on sodium naphthalene sulphonate and 110 parts of water are ground with sand in the presence of 160 parts of quartzite beads for 4 hours. The grinding is effected with ice-cooling at 1500 revolutions per minute of the grinder. After removal of the quartzite beads by filtration 140 parts of a dispersion containing 23% of the active ingredient are obtained.

The cellulose solution containing the active ingredient is extruded through spinerettes according to a conventional procedure into a precipitation bath containing, per liter, 125 g of sulphuric acid, 240 g of anhydrous sodium sulphate and 12 g anhydrous zinc sulphate. The fibres produced are thoroughly washed and formed into knitted products.

EXAMPLE 3

To 200 parts of a cellulose solution based on xanthate, which solution contains 18 parts of α-cellulose, are added consecutively 7.85 parts of an aqueous dispersion of the compound, No. 32 of Table 1 and 9 parts of a 20% aqueous dispersion of 2,4-dianilino-2,4-dioxo-1,3-diphenyl-cyclodiphosphazane with stirring. The production of the resulting flameproofed cellulose is effected in analogous manner to that described in the previous Example.
The compounds in Table 1 following are produced in an analogous manner to that described in Example 1 and are used as described in Examples 2 and 3.
TABLE 1
| No. | formula | m.p. °C. |
|---|---|---|
| 1 | 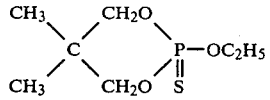 | 64–5 |
| 2 | 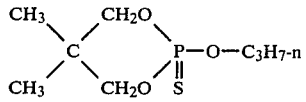 | b.p. 124/2 atm. |
| 3 | 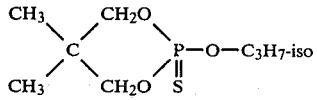 | 88–90 |
| 4 | 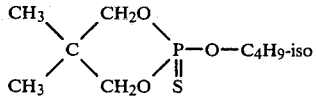 | b.p. 125-7/ 2 atm. |
| 5 | 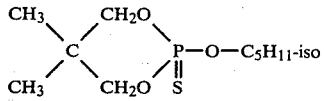 | b.p. 140-2/ 2 atm. |
| 6 | 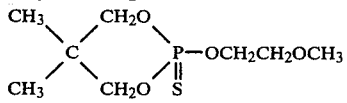 | b.p. 142-4/2 atm. |
| 7 | 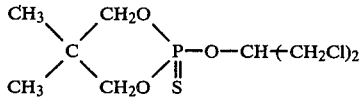 | 83–5 |
| 8 | 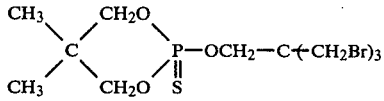 | 121–3 |
| 9 | 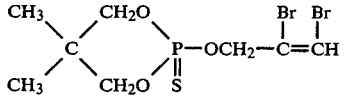 | 49–50 |
| 10 | 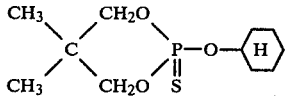 | 51–3 |
| 11 | 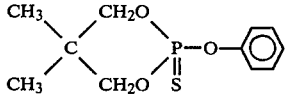 | 100–1 |
| 12 | 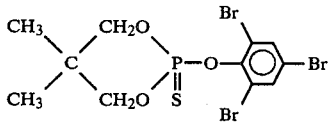 | 162–5 |
| 13 | 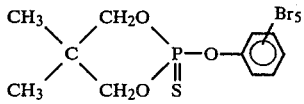 | 250–1 |
| 14 | 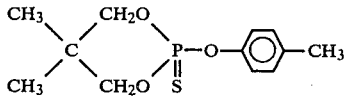 | 72–3 |
| 15 | 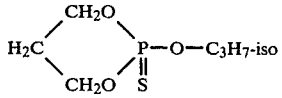 | oil |
| 16 | 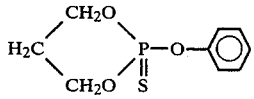 | oil |

TABLE 1-continued
| No. | formula | m.p. °C. |
|---|---|---|
| 17 | 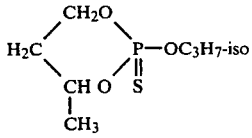 | oil |
| 18 | 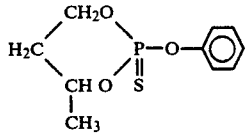 | oil |
| 19 | 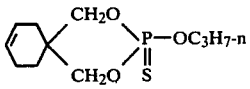 | 53–5 |
| 20 | 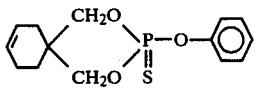 | 124–5 |
| 21 | 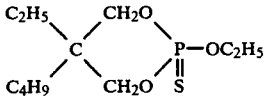 | oil |
| 22 | 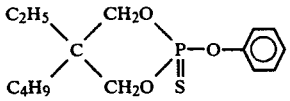 | 62–5 |
| 23 | 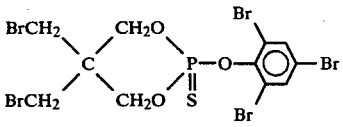 | 225 |
| 24 | 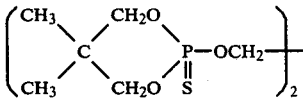 | 176–9 |
| 25 | 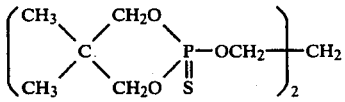 | 125–7 |
| 26 | 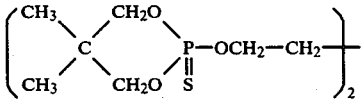 | 166–9 |
| 27 | 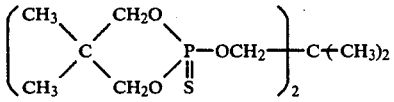 | 164–5 |
| 28 | 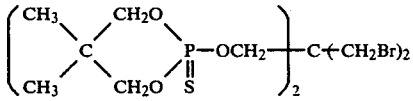 | 171–3 |
| 29 | 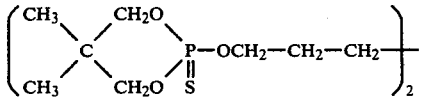 | 106–7 |
| 30 | 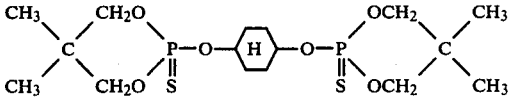 | 228–31 |
| 31 | 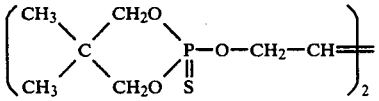 | 138–41 |

TABLE 1-continued

| No. | formula | m.p. °C. |
|---|---|---|
| 32 | 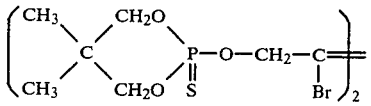 | 174–7 |
| 33 | 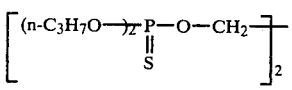 | b.p. 125/0.12 atm. |
| 34 | 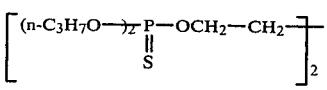 | oil |
| 35 | 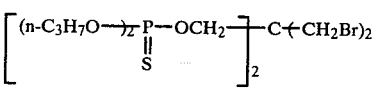 | oil |

What is claimed is:

1. Flameproofed regenerated cellulose containing, as a flameproofing agent, an effective amount of a compound of formula,

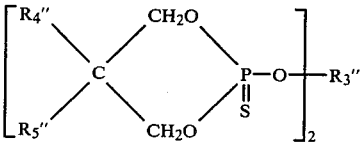

wherein $R_3''$ is straight or branched chain $C_3$–$C_5$ alkylene; or a divalent radical selected from

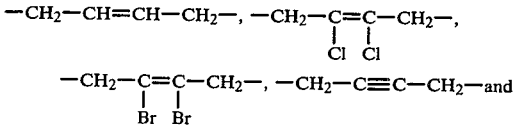

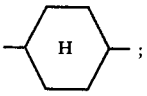

with the proviso that when $R_3''$ is straight or branched chain $C_3$–$C_5$ alkylene, it is other than alkyl-substituted methylene; and each of $R_4''$ and $R_5''$ is, independently, methyl; ethyl; $—CH_2Cl$; or $—CH_2Br$; with the provisos that: (a) when $R_4''$ is $—CH_2Br$, $R_5''$ is other than $—CH_2Cl$; and (b) when $R_5''$ is $CH_2Br$, $R_4''$ is other than $—CH_2Cl$.

2. Flameproofed regenerated cellulose according to claim 1 containing, as a flameproofing agent, the compound of the formula

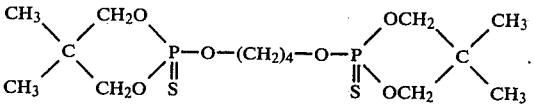

3. Flameproofed regenerated cellulose according to claim 1 containing, as a flameproofing agent, the compound of the formula

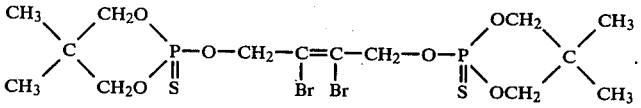

4. Flameproofed regenerated cellulose according to claim 1 containing, as a flameproofing agent, the compound of the formula

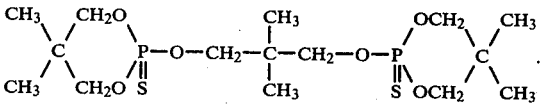

5. A method for producing flameproofed regenerated cellulose comprising regenerating cellulose from a cellulose-containing medium containing a flameproofing effective amount of a flameproofing agent of the formula

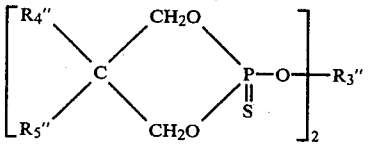

wherein $R_3''$ is straight or branched chain $C_3$–$C_5$ alkylene; or a divalent radical selected from

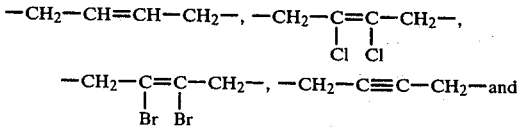

-continued

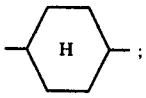

with the proviso that when $R_3''$ is straight or branched chain $C_3$–$C_5$ alkylene, it is other than alkyl-substituted methylene; and each of $R_4''$ and $R_5''$ is, independently, methyl; ethyl; $—CH_2Cl$; or $—CH_2Br$; with the provisos that: (a) when $R_4''$ is $—CH_2Br$, $R_5''$ is other than $—CH_2Cl$; and (b) when $R_5''$ is $CH_2Br$, $R_4''$ is other than $—CH_2Cl$.

6. A method according to claim 5, wherein the amount of said flameproofing agent is from 8% to 25% of the weight of the cellulose in the cellulose-containing medium.

7. A method according to claim 5 wherein the cellulose-containing medium contains, in addition to the flameproofing agent, a reaction product of a phosphorus nitrile chloride with a glycol, a cyclodiphosphazane or a thionocyclodiphosphazane.

8. A method for producing flameproofed regenerated cellulose comprising applying to regenerated cellulose a solution or an aqueous dispersion containing a flameproofing effective amount of a flameproofing agent of the formula

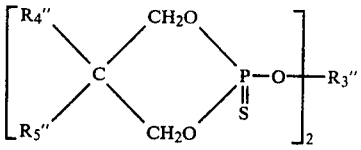

wherein $R_3''$ is straight or branched chain $C_3$–$C_5$ alkylene; or a divalent radical selected from $$—CH_2—CH=CH—CH_2—,\ —CH_2—\underset{Cl}{C}=\underset{Cl}{C}—CH_2—,$$

$$—CH_2—\underset{Br}{C}=\underset{Br}{C}—CH_2—,\ —CH_2—C\equiv C—CH_2—\text{and}$$

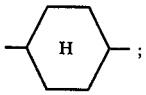

with the proviso that when $R_3''$ is straight or branched chain $C_3$–$C_5$ alkylene, it is other than alkyl-substituted methylene; and each of $R_4''$ and $R_5''$ is, independently, methyl; ethyl; $—CH_2Cl$; or $—CH_2Br$; with the provisos that: (a) when $R_4''$ is $—CH_2Br$, $R_5''$ is other than $—CH_2Cl$; and (b) when $R_5''$ is $CH_2Br$, $R_4''$ is other than $—CH_2Cl$.

* * * * *

UNITED STATES PATENT AND TRADEMARK OFFICE

CERTIFICATE OF CORRECTION

PATENT NO. : 4,242,138

DATED : December 30, 1980

INVENTOR(S) : Claudine Mauric/Rainer Wolf

It is certified that error appears in the above—identified patent and that said Letters Patent is hereby corrected as shown below:

Title page, left-hand column, under the heading "Related U.S. Application Data"; after "1976", insert --, now abandoned--.

Column 1, line 6; after "1976", delete "pending in group" and substitute therefor --, now abandoned--.

Column 2, in the first row of structural formulae directly beneath line 23; after " 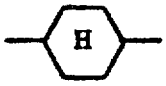 ", insert a comma.

Column 2, in the second row of structural formulae directly beneath line 23; after " 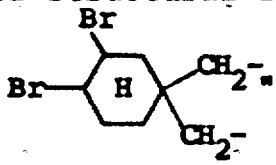 ", insert a comma.

Signed and Sealed this

Twentieth Day of July 1982

[SEAL]

Attest:

GERALD J. MOSSINGHOFF

Attesting Officer

Commissioner of Patents and Trademarks